US012188476B2

(12) United States Patent
Li et al.

(10) Patent No.: US 12,188,476 B2
(45) Date of Patent: Jan. 7, 2025

(54) FAN AND CLEANING DEVICE

(71) Applicant: Beijing Roborock Technology Co., Ltd., Beijing (CN)

(72) Inventors: Changcheng Li, Beijing (CN); Xing Li, Beijing (CN)

(73) Assignee: BEIJING ROBOROCK TECHNOLOGY CO., LTD., Beijing (CN)

( * ) Notice: Subject to any disclaimer, the term of this patent is extended or adjusted under 35 U.S.C. 154(b) by 6 days.

(21) Appl. No.: 18/008,978

(22) PCT Filed: Jun. 17, 2021

(86) PCT No.: PCT/CN2021/100730
§ 371 (c)(1),
(2) Date: Dec. 8, 2022

(87) PCT Pub. No.: WO2022/052552
PCT Pub. Date: Mar. 17, 2022

(65) Prior Publication Data

US 2023/0220852 A1 Jul. 13, 2023

(30) Foreign Application Priority Data

Sep. 14, 2020 (CN) ..... 202010962008.1

(51) Int. Cl.
*F04D 17/16* (2006.01)
*F04D 29/42* (2006.01)
*F04D 29/44* (2006.01)

(52) U.S. Cl.
CPC ..... *F04D 17/168* (2013.01); *F04D 29/4253* (2013.01); *F04D 29/444* (2013.01)

(58) Field of Classification Search
CPC ..... A47L 5/22; F04D 17/165; F04D 17/168; F04D 25/0606; F04D 29/4253;
(Continued)

(56) References Cited

U.S. PATENT DOCUMENTS 2,956,731 A * 10/1960 Bayuk ..... F04D 19/002 417/423.14
10,598,189 B2 * 3/2020 Liu ..... F04D 29/056
(Continued)

FOREIGN PATENT DOCUMENTS

CN 206221314 U 6/2017
CN 107614888 A 1/2018
(Continued)

OTHER PUBLICATIONS

International Search Report and Written Opinion from PCT/US2021/100730 dated Sep. 15, 2021.
(Continued)

*Primary Examiner* — Devon C Kramer
*Assistant Examiner* — Joseph S. Herrmann
(74) *Attorney, Agent, or Firm* — Calfee, Halter & Griswold LLP

(57) ABSTRACT

A fan including: a motor stator; an axial diffuser, fixedly connected to the motor stator and comprising an outer cylinder, a main body portion disposed in the outer cylinder, and diffuser blades connected to the outer cylinder and the main body portion, the diffuser blades separating an annular space between the outer cylinder and the main body portion into more than one pressure diffusion ducts, the main body portion being provided with a central shaft hole; an air inlet cover, fixedly connected to the axial diffuser, the air inlet cover and the axial diffuser forming an impeller chamber and an annular no-gate channel around the impeller chamber, the annular no-gate channel communicating with the impeller chamber and the pressure diffusion ducts, and the air inlet cover being provided with an air inlet; and an impeller, disposed in the impeller chamber and used to introduce air from the air inlet.

17 Claims, 3 Drawing Sheets

(58) Field of Classification Search
CPC ..... F04D 29/441; F04D 29/444; H02K 5/15; H02K 5/26
See application file for complete search history.

(56) References Cited

U.S. PATENT DOCUMENTS

| | | | | |
|---|---|---|---|---|
| 2010/0215489 | A1* | 8/2010 | Johnson | F04D 29/444 415/208.2 |
| 2015/0351599 | A1* | 12/2015 | Park | F04D 29/541 310/68 B |
| 2017/0033637 | A1* | 2/2017 | Matsuoka | H02K 3/524 |
| 2018/0100517 | A1* | 4/2018 | Sawada | A47L 9/00 |
| 2018/0159385 | A1* | 6/2018 | Horng | H02K 1/02 |
| 2022/0290689 | A1* | 9/2022 | Zhang | A47L 5/22 |

FOREIGN PATENT DOCUMENTS

| | | | |
|---|---|---|---|
| CN | 109185196 | A | 1/2019 |
| CN | 110617230 | A | 12/2019 |
| CN | 210290212 | U | 4/2020 |
| CN | 111441969 | A | 7/2020 |
| CN | 211397958 | U | 9/2020 |
| CN | 212536158 | U | 2/2021 |
| CN | 212536246 | U | 2/2021 |
| CN | 212543466 | U | 2/2021 |
| JP | 2001513861 | A | 9/2001 |

OTHER PUBLICATIONS

Extended European Search Report of application No. 21865610.6 dated Sep. 6, 2024.

* cited by examiner

FAN AND CLEANING DEVICE

CROSS-REFERENCE TO RELATED APPLICATION

The present disclosure is a US national phase of a PCT application under PCT/CN2021/100730, filed on Jun. 17, 2021, which claims priority to Chinese Patent Application No. 202010962008.1, filed on Sep. 14, 2020, both of which are incorporated herein by reference in their entireties.

TECHNICAL FIELD

The present disclosure relates to the technical field of cleaning devices, and in particular, to a fan and a cleaning device.

BACKGROUND

Fan, as a machine that increases the gas pressure depending on input mechanical energy and discharges gas, is a driven fluid machine. Fan is the customary abbreviation of a machine for gas compression and gas conveying in China.

Fan is widely used in various fields, for example, vacuum cleaners in household appliances, etc. For the design of a centrifugal fan, a diffuser is generally disposed in a radial air outlet direction. First, it can play the role of a guide vane to introduce chaotic airflow from an impeller to a more regular flow direction; second, it can convert the dynamic pressure of air to a static pressure, and thus reduce the flow rate of the air and energy loss.

However, the presence of a radial diffuser leads to an increase in the diameter of the fan, or to take up space for a rotating impeller, thereby making it necessary to increase the rotation speed to achieve the required power. The increase of the rotation speed will bring a series of problems, such as the shortening of bearing life and the increase of fan noise.

SUMMARY

In an aspect, embodiments of the present disclosure provide a fan. The fan includes: a motor stator;

an axial diffuser, fixedly connected to the motor stator, where the axial diffuser includes an outer cylinder, a main body portion arranged in the outer cylinder, and diffuser blades connected to the outer cylinder and the main body portion; the diffuser blades separate an annular space between the outer cylinder and the main body portion into more than one pressure diffusion duct; and the main body portion is provided with a central shaft hole;

an air inlet cover, fixedly connected to the axial diffuser, where an impeller chamber and an annular no-gate channel surrounding the impeller chamber are formed between the air inlet cover and the axial diffuser, the annular no-gate channel communicates the impeller chamber with the pressure diffusion duct; and the air inlet cover is provided with an air inlet; and an impeller, arranged in the impeller chamber, where the impeller is used to introduce air from the air inlet, and the impeller drives the air into the pressure diffusion duct through the annular no-gate channel and to flow out from another end of the pressure diffusion duct.

In an alternative embodiment, the outer diameter of the main body portion of the axial diffuser is equal to the outer diameter of the motor stator, so that the air flowing out from the pressure diffusion duct flows through the outside of the motor stator.

In an alternative embodiment, one of the axial diffuser and the motor stator includes more than one positioning post, and the other of the axial diffuser and the motor stator includes more than one positioning groove mated with the positioning post.

In an alternative embodiment, some diffuser blades of the diffuser blades of the axial diffuser extend along an axial direction of the axial diffuser to form the positioning post, and the motor stator includes the positioning groove.

In an alternative embodiment, an end of the diffuser blades integrally extends along the axial direction of the axial diffuser to form the positioning post, or portion of the end of the diffuser blades extends along the axial direction of the axial diffuser to form the positioning post.

In an alternative embodiment, an outer peripheral surface of the motor stator is recessed inward to form the positioning groove, a wall surface of the positioning groove is a cylindrical surface, and the positioning post is provided with a cylindrical surface mated with the wall surface of the positioning groove.

In an alternative embodiment, the positioning groove is located on the outer peripheral surface corresponding to a tooth centerline of the motor stator.

In an alternative embodiment, the number of the positioning groove and the number of the positioning post are three respectively; and the positioning groove and the positioning post are evenly distributed on the respective circumferences.

In an alternative embodiment, the axial diffuser includes more than one connecting hole, and the motor stator includes more than one connecting post mated with the connecting hole.

In an alternative embodiment, the length of the connecting post is less than the length of the positioning post; and the more than one connecting hole is formed in the main body portion.

In an alternative embodiment, an end face of a side of the outer cylinder close to the air inlet cover is provided with a first annular protrusion, so that the end face of the outer cylinder forms a first stepped surface, and a side of an outer wall surface of the outer cylinder extends axially to form the first annular protrusion; and the air inlet cover is provided with a second annular protrusion, so that the end face connecting the air inlet cover and the outer cylinder forms a second stepped surface, wherein the second stepped surface is mated with the first stepped surface.

In an alternative embodiment, the number of blades of the impeller is odd.

In an alternative embodiment, the number of blades of the impeller and the number of the diffuser blades are not a multiple of each other.

In an alternative embodiment, the number of blades of the impeller is a multiple of 3.

In an alternative embodiment, the number of blades of the impeller is less than the number of the diffuser blades.

In a second aspect, embodiments of the present disclosure provide a cleaning device. The cleaning device includes the fan according to any one of the above-mentioned embodiments.

Understandably, the foregoing general description and the following detailed description are only exemplary and illustrative, and are not intended to limit the present disclosure.

A summary of various implementations or examples of the technology described in this disclosure is not a comprehensive disclosure of the full scope or all features of the disclosed technology.

BRIEF DESCRIPTION OF THE DRAWINGS

In the drawings, which are not drawn necessarily to scale, the same reference numbers may describe similar parts in different views. The same reference numbers with letter suffixes or different letter suffixes may denote different instances of similar components. The drawings illustrate various embodiments generally by way of example, but not by way of limitation, and together with the description and claims, serve to explain embodiments of the present disclosure. In due course, the same reference numbers will be used throughout the drawings to refer to the same or similar parts. Such embodiments are illustrative, and are not intended to be exhaustive or exclusive embodiments of the present device or method.

DETAILED DESCRIPTION

Figure 1:
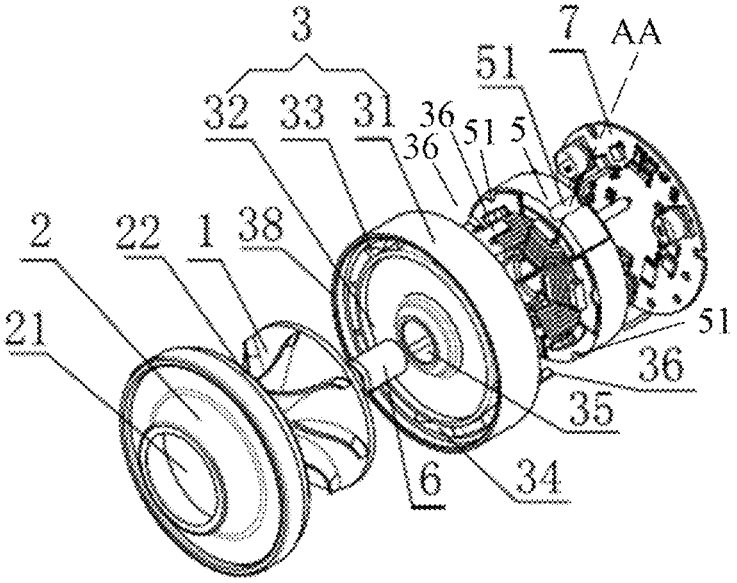
FIG. 1 shows a structural schematic exploded view of a fan according to an embodiment of the present disclosure.
Figure 2:
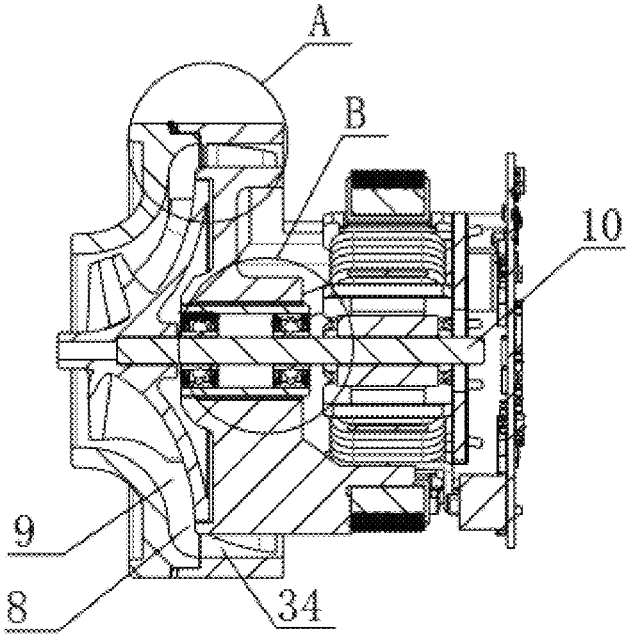
FIG. 2 shows a sectional structural schematic view of a fan according to an embodiment of the present disclosure.
Figure 3:
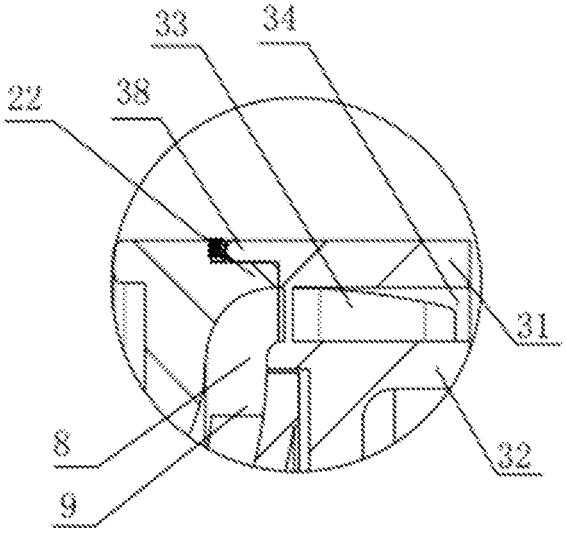
FIG. 3 shows an enlarged view of a part A in FIG. 2.
Figure 4:
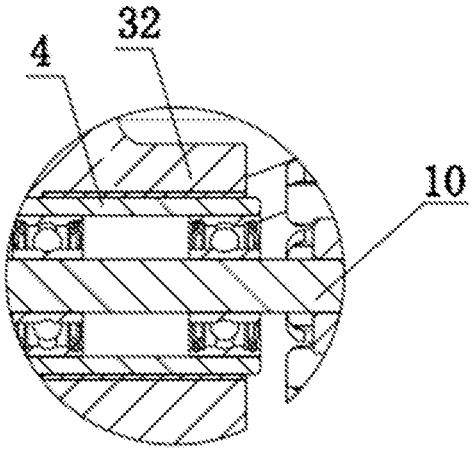
FIG. 4 shows an enlarged view of a part B in FIG. 2.
Figure 5:
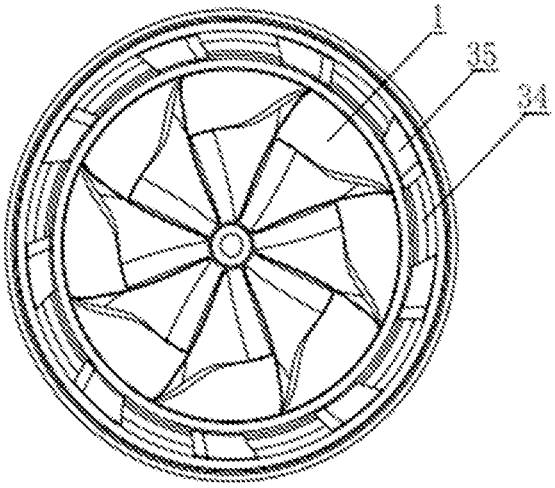
FIG. 5 shows a schematic diagram of an end face of an impeller and a diffuser assembly in a fan according to an embodiment of the present disclosure.
Figure 6:
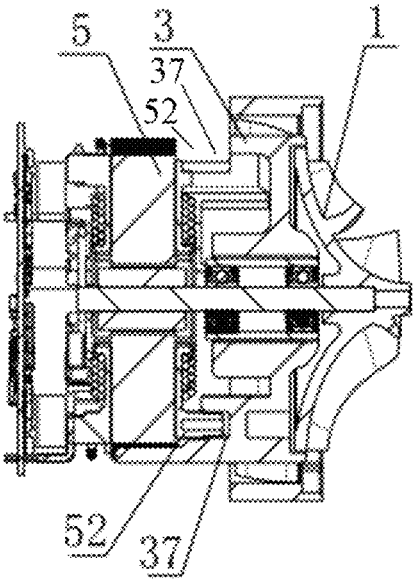
FIG. 6 shows a sectional structural schematic view of a fan according to another embodiment of the present disclosure.

For clearer descriptions of the objectives, technical solutions, and advantages of embodiments of the present disclosure, the technical solutions of the embodiments of the present disclosure will be described clearly and completely hereinafter in conjunction with the accompanying drawings of the embodiments of the present disclosure. Obviously, the described embodiments are some, but not all, embodiments of the present disclosure. Based on the described embodiments of the present disclosure, all other embodiments obtained by those of ordinary skill in the art without creative work shall fall within the protection scope of the present disclosure.

Unless otherwise defined, the technical or scientific terms used in the present disclosure shall have the ordinary meaning as understood by those of general skill in the art to which the present disclosure belongs. The terms such as "first", "second" and similar terms used in the present disclosure do not denote any order, quantity, or importance, but are merely used to distinguish different components. The word "comprise" or "include" and similar terms mean that elements or objects appearing before the word encompass the listed elements or objects and its equivalents appearing after the word, while other elements or objects are not excluded. The words "connected" or "connecting" and the like are not limited to physical or mechanical connection, but may include electrical connection, and the connection may be direct or indirect. The words, such as "upper", "lower, "left" and "right" are only used to indicate a relative positional relationship. When an absolute position of the described object changes, the relative positional relationship may also change accordingly.

The detailed descriptions of known functions and components are omitted in order to keep the following description of the embodiments of the present disclosure clear and concise.

An embodiment of the present disclosure provides a fan. The fan includes: a motor stator 5; an axial diffuser 3, fixedly connected to the motor stator 5, where the axial diffuser includes an outer cylinder 31, a main body portion 32 arranged in the outer cylinder 31, and diffuser blades 33 connecting the outer cylinder 31 and the main body portion 32, the diffuser blades 33 separate an annular space between the outer cylinder 31 and the main body portion 32 into more than one pressure diffusion duct 34, and the main body portion 32 is provided with a center shaft hole 35; an air inlet cover 2, fixedly connected to the axial diffuser 3, where an impeller chamber 9 and an annular no-gate channel 8 surrounding the impeller chamber 9 are formed between the air inlet cover 2 and the axial diffuser 3, the annular no-gate channel 8 communicates the impeller chamber 9 with the pressure diffusion duct 34, and the air inlet cover 2 is provided with an air inlet 21; and an impeller 1, arranged in the impeller chamber 9, where the impeller 1 is used to introduce air from the air inlet 21, and to drive the air into the pressure diffusion duct 34 through the annular no-gate channel 8 to flow out from another end of the pressure diffusion duct 34.

In the fan according to the embodiment of the present disclosure, the radial diffuser is cancelled and the axial diffuser 3 is used, so that chaotic airflow from the impeller 1 directly enters the axial diffuser 3 through the annular no-gate channel 8, and tends to be stable after being guided by the diffuser blades 33 of the axial diffuser 3, thereby reducing the generation of vortices in a flow channel. The cancellation of radial diffuser can effectively reduce wind resistance, reduce energy loss, and improve the working efficiency of the fan. As the "dynamic and static clearance" increases, the "dynamic and static interference" effect of the fan during operation is weakened and the fan noise is reduced.

The radial diffuser is generally provided with axial diffuser blades at the position of the annular no-gate channel 8 of the present disclosure to form a radial air passage, which is often very close to the blades. Air directly hits the front edges of the blades 33 of the radial diffuser after flowing out of the impeller 1, so that strong "dynamic and static interference" occurs. A large number of documents have proved that the "dynamic and static interference" generated by the rotor 6 and the blades of the motor stator 5 is an important part of the fan noise. The fan according to the embodiment of the present disclosure cancels the radial diffuser, and adopts the axial diffuser 3 to increase the "dynamic and static clearance", which is a very powerful means to reduce the fan noise.

Due to the cancellation of the radial diffuser, the diameter of the fan can be reduced accordingly. Thus, the problems of shortening the life of the bearing 4 and increasing the fan noise, as the power needs to be increased due to an increase in the diameter of the fan, are avoided.

In some embodiments, the outer diameter of the main body portion 32 of the axial diffuser 3 is equal to the outer diameter of the motor stator 5, so that the air flowing out from the pressure diffusion duct 34 flows through the outside of the motor stator 5. In the embodiment of the present disclosure, the outer diameter of the main body portion 32 of the axial diffuser 3 is equal to the outer diameter of the motor stator 5, so that a fluid can flow out from the axial diffuser 3 through an outer ring of the motor stator 5 without obstacles. The air resistance is reduced and the fluid efficiency is improved since the air flows through the outside of the motor stator 5.

In the embodiment of the present disclosure, the outer diameter of the main body portion 32 of the axial diffuser 3 is equal to the outer diameter of the motor stator 5, but is not absolutely equal, and a certain difference therebetween is allowed. For example, the difference may be 1%, 3%, 5%, 7%, 10%, etc.

In some embodiments, one of the axial diffuser 3 and the motor stator 5 includes more than one positioning post 36, and the other of the axial diffuser 3 and the motor stator 5 includes more than one positioning groove 51 mated with the positioning post 36. The axial diffuser 3 and the motor stator 5 are fixed conveniently by providing the positioning post 36 and the positioning groove 51 on the axial diffuser 3 and the motor stator 5 correspondingly.

The positioning post 36 may be provided on either of the axial diffuser 3 and the motor stator 5, while the positioning groove 51 may be provided on the other. For example, the positioning post 36 may be provided on the axial diffuser 3, while the positioning groove 51 may be provided on the motor stator 5.

In some embodiments, the positioning post 36 extends in an axial direction of the axial diffuser 3. In an exemplary embodiment, some of the diffuser blades 33 of the axial diffuser 3 extend along the axial direction of the axial diffuser 3 to form the positioning posts 36, and the motor stator 5 includes the positioning groove 51. The number of the positioning posts 36 is not the same as the number of the diffuser blades 33. In general, the number of the positioning posts 36 may be less than the number of the diffuser blades 33. Therefore, when the positioning post 36 is arranged on the axial diffuser 3, it may be the case that some of the diffuser blades 33 extend along the axial direction to form the positioning posts 36. For example, 3 diffuser blades 33 of 12 diffuser blades 33 extend along the axial direction to form the positioning posts 36. In the embodiment of the present disclosure, the diffuser blades 33 extend along the axial direction of the axial diffuser 3 to form the positioning posts 36, which can make the positioning posts 36 be provided with enough strength without affecting the structure of the axial diffuser 3, and meanwhile can reduce the consumption of material. Thus, the following situation is avoided: the thickness of a position where the positioning posts 36 are located, needs to be increased to improve the strength of the positioning posts 36.

In an exemplary embodiment, an end of the diffuser blade 33 may integrally extend along the axial direction of the axial diffuser 3 to form the positioning post 36. Alternatively, a portion of the end of the diffuser blade 33 extends in the axial direction of the axial diffuser 3 to form the positioning post 36. When a portion of the end of the diffuser blade 33 extends along the axial direction of the diffuser 3 to form the positioning post 36, it may, for example, the case that a side of the diffuser blade 33 close to the main body portion 32 extends along the axial direction of the axial diffuser 3 to form the positioning post 36.

In some embodiments, the positioning post 36 may be formed on the main body portion 32. In an exemplary embodiment, the positioning post 36 may be located on a position on the main body portion 32 corresponding to the diffuser blade 33.

In some embodiments, one positioning post may be partially formed on the main body portion 32 and partially formed by the extension of the diffuser blade 33.

In the embodiment of the present disclosure, the positioning groove 51 may be a hole groove or an open groove. In some embodiments, an outer peripheral surface of the motor stator 5 is recessed inward to form the positioning groove 51. The positioning groove 51 formed by the outer peripheral surface of the positioning groove 51 recessed inward is an open groove, which can not only ensure firmly positioning, but also save material while ensuring the strength. A wall surface of the positioning groove 51 is a cylindrical surface, and the positioning post 36 is provided with a cylindrical surface mated with the wall surface of the positioning groove 51. The wall surface of the positioning groove 51 and the corresponding mating surface of the positioning post 36 are cylindrical surfaces, which effectively ensures the stability of the combination of the positioning groove and positioning post.

In some embodiments, the positioning post 36 is a semi-cylindrical body. One side of the positioning post 36 is provided with a cylindrical surface mated with the wall surface of the positioning groove 51, and the other side matches with a peripheral surface of the motor stator 5.

In the embodiment of the present disclosure, the positioning groove 51 may be provided at any position on the peripheral surface of the motor stator 5. In some embodiments, the positioning groove 51 is located on the outer peripheral surface corresponding to a tooth centerline AA of the motor stator 5. The positioning groove 51 is provided on the outer peripheral surface opposite to the teeth of the motor stator 5. There is enough space for providing the positioning groove at the position, which ensures the strength and avoids an increase in material consumption caused by additionally increasing the thickness and other dimensions of the part where the positioning groove 51 is located.

In the embodiment of the present disclosure, the number of the positioning grooves 51 and the number of the positioning posts 36 are not specifically limited, and may be, for example, 2, 3, 4, etc. In some embodiments, the number of the positioning grooves 51 and the number of the positioning posts 36 are 3 respectively, and the positioning grooves 51 and the positioning posts 36 are evenly distributed on their respective circumferences. Three positioning grooves 51 and three positioning posts 36 can ensure the positioning of and connection between the axial diffuser 3 and the motor stator 5. More than one positioning grooves 51 are distributed on a circumference. More than one positioning posts 36 are also distributed evenly on a circumference. The diameters of the circumferences where the positioning grooves 51 and the positioning posts 36 are distributed respectively are the same. The positioning grooves 51 and the positioning posts 36 are evenly distributed on their respective circumferences, and when the axial diffuser 3 and the motor stator 5 are connected, it is not necessary to limit the axial diffuser 3 and the motor stator 5 in a specific orientation. Any one of the positioning posts 36 can be mated with any one of the positioning grooves 51.

In the embodiment of the present disclosure, the fixed connection mode between the axial diffuser 3 and the motor stator 5 is not limited. For example, the axial diffuser 3 and the motor stator 5 may be bonded to each other through an adhesive, or connected by an interference fit, or connected by a threaded member, and so on.

In some embodiments, one of the axial diffuser 3 and the motor stator 5 include more than one connecting post 52, and the other one of the axial diffuser 3 and the motor stator 5 includes more than one connecting hole 37 mated with the connecting post 52. The axial diffuser 3 and the motor stator 5 are connected by the cooperation of the connecting hole 37 and the connection post 52. For example, the connecting post 52 and a hole wall of the connecting hole 37 are fixedly connected through an adhesive. In this way, the adhesive may be applied in a specific position to avoid defects such as adhesive overflow. Alternatively, the connecting post 52 and the connecting hole 37 are fixedly connected by an interference fit.

In an exemplary embodiment, the axial diffuser 3 includes more than one connecting hole 37, and the motor stator 5 includes more than one connecting post 52 that are mated with the connecting hole 37. For example, more than one connecting hole 37 may be provided on the main body portion 32.

In the fan according to the embodiment of the present disclosure, the corresponding connecting post 52 and the connecting hole 37 as well as the corresponding positioning post 36 and the positioning groove 51 may be included at the same time.

In some embodiments, the circle where the corresponding connecting post 52 and the connecting hole 37 are located is collinear with the axis of the circle where the corresponding positioning post 36 and the positioning groove 51 are located. In an exemplary embodiment, the radius of the circle where the corresponding connecting post 52 and the connecting hole 37 are located may be smaller than the radius of the circle where the corresponding positioning post 36 and the positioning groove 51 are located.

In some embodiments, the length of the connecting post 52 is less than that of the positioning post 36. During assembly, the positioning of the axial diffuser 3 and the motor stator 5 may be achieved through the cooperation of the positioning post 36 and the positioning groove 51, so that the connecting post 52 is aligned to the connecting hole 37, which is convenient for assembly.

In some embodiments, an end face of a side of the outer cylinder 31 close to the air inlet cover 2 is provided with a first annular protrusion 38, so that the end face of the outer cylinder 31 forms a first stepped surface, and a side of an outer wall surface of the outer cylinder 31 extends axially to form the first annular protrusion; the air inlet cover 2 is provided with a second annular protrusion 22, so that an end face of the air inlet cover 2 connected to the outer cylinder 31 forms a second stepped surface. The second stepped surface is mated with the first stepped surface. The stepped surfaces are provided at a position where the outer cylinder 31 is connected to the air inlet cover 2, so that an inner wall surface of the position where the air inlet cover 2 is connected to the outer cylinder 31 is provided with a smoother transition, thereby reducing the interference to the fluid.

In some embodiments, the number of blades of the impeller 1 is odd. For example, the number of blades of impeller 1 is 3, 5, 7, 9, 11, etc. The impeller 1 has an odd number of blades, which can reduce asymmetrical residual injection molding stress and reduce resonance.

In some embodiments, the number of blades of the impeller 1 and the number of the diffuser blades 33 are not a multiple of each other. The number of the diffuser blades 33 is a selected number which is not divided by the number of blades of the impeller 1, so that the air noise can be reduced. For example, the number of blades of impeller 1 is 7 and the number of the diffuser blades 33 is 12.

In some embodiments, the number of diffuser blades 33 is a multiple of 3. The number of the diffuser blades 33 is a multiple of 3, which facilitates providing the positioning posts 36. Three positioning posts 36 can ensure the positioning of the axial diffuser 3 and the motor stator 5. The positioning posts 36 are evenly distributed on the circumference, and the assembly of the axial diffuser 3 and the motor stator 5 is used. When the positioning posts 36 are formed by extension of the diffuser blades 33, the number of the diffuser blades 33 being a multiple of 3 can ensure the uniform distribution of the positioning posts 36. The number of diffuser blades 33 may be, for example, 9, 12, 15, or the like. Of course, in the embodiment of the present disclosure, it is not excluded that the number of the diffuser blades 33 is a number other than a multiple of 3.

In some embodiments, the number of blades of the impeller 1 is less than the number of the diffuser blades 33. Thus, while the blades of the impeller 1 meet the air suction efficiency, the number of the diffuser blades 33 also meets the rectification efficiency.

In some embodiments, the diffuser blades 33 may be inclined. That is, the axis of the diffuser blade 33 is not parallel to that of the axial diffuser 3. The axis of the pressure diffusion duct 34 is also not parallel to that of the axial diffuser 3. In an exemplary embodiment, an angle formed between the axis of the pressure diffusion duct 34 and the axis of the axial diffuser 3 may be 10°-45°.

In the embodiment of the present disclosure, the axial diffuser 3 is assembled on a motor shaft 10 through a bearing 4. The impeller 1 is fixed on the motor.

The fan of the embodiment of the present disclosure further includes a rotor 6 and a control circuit board 7. The rotor 6 is fixed on the motor shaft 10. The control circuit board 7 is connected to the motor stator 5.

An embodiment of the present disclosure provides a cleaning device, which includes the fan according to any of the foregoing embodiments.

In the fan of the cleaning device according to the embodiment of the present disclosure, the radial diffuser is cancelled, and the axial diffuser 3 is used, so that chaotic airflow from the impeller 1 directly enters the axial diffuser 3 through the annular no-gate channel 8, and tends to be stable after being guided by the diffuser blades 33 of the axial diffuser 3, thereby reducing the generation of vortices in the flow channel. The cancelation of radial diffuser can effectively reduce air resistance, reduce energy loss, and improve the working efficiency of the fan. As the "dynamic and static clearance" increases, the "dynamic and static interference" effect of the cleaning device during operation is weakened and the fan noise is reduced.

The radial diffuser is generally provided at the position of the annular no-gate channel 8, which is often very close to the blades. Air directly hits the front edges of the radial diffuser blades 33 after flowing out of the impeller 1, so that a strong "dynamic and static interference" occurs. A large number of documents have proved that the "dynamic and static interference" generated by the rotor 6 and the blades of the motor stator 5 is an important part of the fan noise. The cleaning device according to the embodiment of the present disclosure cancels the radial diffuser, and adopts the axial diffuser 3 to increase the "dynamic and static clearance", which is a very powerful means to reduce the fan noise.

Due to the cancellation of the radial diffuser, the diameter of the fan can be reduced accordingly. Thus, the problems of shortening the life of the bearing 4 and increasing the fan noise, as the power needs to be increased due to an increase in the diameter of the fan, are avoided.

The cleaning device according to the embodiment of the present disclosure includes a sweeping robot, a hand-held vacuum cleaner, and the like.

The above description is intended to be illustrative rather than restrictive. For example, the above-described examples (or one or more schemes of them) may be used in combination with each other, and it is contemplated that the embodiments may be combined with each other in various combinations or permutations. The scope of the present disclosure should be determined with reference to the appended claims, along with the full scope of equivalents to which such claims are entitled.

Reference numerals in the accompanying drawings:

1—impeller; 2—air inlet cover; 21—air inlet; 22—second annular protrusion; 3—axial diffuser; 31—outer cylinder; 32—main body portion; 33—diffuser blade; 34—pressure diffusion duct; 35—central shaft hole; 36—positioning post; 37—connecting hole; 38—first annular protrusion; 4—bearing; 5—motor stator; 51—positioning groove; 52—connecting post; 6—rotor; 7—control circuit board; 8—annular no-gate channel; 9—impeller chamber; and 10—motor shaft.

What is claimed is:

1. A fan, comprising:

a motor stator;

an axial diffuser, fixedly connected to the motor stator, wherein, the axial diffuser comprises an outer cylinder, a main body portion arranged in the outer cylinder, and diffuser blades connected to the outer cylinder and the main body portion; the diffuser blades separate an annular space between the outer cylinder and the main body portion into more than one pressure diffusion duct;

an air inlet cover, fixedly connected to the axial diffuser, wherein the air inlet cover is provided with an air inlet; and an impeller, configured to introduce air from the air inlet, wherein the impeller drives the air into one end of the more than one pressure diffusion duct and to flow out from another end of the more than one pressure diffusion duct;

wherein, the axial diffuser comprises more than one positioning post, and the motor stator comprises more than one positioning groove mated with the more than one positioning post; and some of the diffuser blades extend along an axial direction of the axial diffuser to form the more than one positioning post.

2. The fan according to claim 1, wherein, an impeller chamber and an annular no-gate channel surrounding the impeller chamber are formed between the air inlet cover and the axial diffuser, and the annular no-gate channel communicates the impeller chamber with the more than one pressure diffusion duct.

3. The fan according to claim 1, wherein, an outer diameter of the main body portion is equal to an outer diameter of the motor stator, enabling the air flowing out from the more than one pressure diffusion duct to flow through an outside of the motor stator.

4. The fan according to claim 1, wherein, an end of the diffuser blades integrally extends along the axial direction of the axial diffuser to form the more than one positioning post, or a portion of the end of the diffuser blades extends along the axial direction of the axial diffuser to form the more than one positioning post.

5. The fan according to claim 1, wherein, an outer peripheral surface of the motor stator is recessed inward to form the more than one positioning groove, a wall surface of each of the more than one positioning groove is a cylindrical surface, and each of the more than one positioning post is provided with a cylindrical surface mated with the wall surface of each of the more than one positioning groove respectively.

6. The fan according to claim 5, wherein, each of the more than one positioning groove is located on the outer peripheral surface respectively corresponding to a tooth centerline of the motor stator.

7. The fan according to claim 1, wherein, a number of the more than one positioning groove and a number of the more than one positioning post are three respectively; and the more than one positioning groove and the more than one positioning post are evenly distributed on respective circumferences.

8. The fan according to claim 1, wherein, the axial diffuser comprises more than one connecting hole, and the motor stator comprises more than one connecting post mated with the more than one connecting hole.

9. The fan according to claim 8, wherein, a length of the more than one connecting post is less than a length of the more than one positioning post; and the more than one connecting hole is formed in the main body portion.

10. The fan according to claim 1, wherein, an end face of a side of the outer cylinder close to the air inlet cover is provided with a first annular protrusion, the end face of the outer cylinder forms a first stepped surface, and a side of an outer wall surface of the outer cylinder extends axially to form the first annular protrusion; and the air inlet cover is provided with a second annular protrusion, an end face of the air inlet cover connected to the outer cylinder forms a second stepped surface, and the second stepped surface is mated with the first stepped surface.

11. The fan according to claim 1, wherein, a number of blades of the impeller is odd.

12. The fan according to claim 1, wherein, a number of blades of the impeller and a number of the diffuser blades are not a multiple of each other.

13. The fan according to claim 1, wherein, a number of blades of the impeller is less than a number of the diffuser blades.

14. The fan according to claim 1, wherein, the motor stator comprises more than one positioning post, and the axial diffuser comprises more than one positioning groove mated with the more than one positioning post.

15. A cleaning device, comprising a fan, wherein the fan comprises:

a motor stator;

an axial diffuser, fixedly connected to the motor stator, wherein, the axial diffuser comprises an outer cylinder, a main body portion arranged in the outer cylinder, and diffuser blades connected to the outer cylinder and the main body portion; the diffuser blades separate an annular space between the outer cylinder and the main body portion into more than one pressure diffusion duct;

an air inlet cover, fixedly connected to the axial diffuser, wherein the air inlet cover is provided with an air inlet; and an impeller, configured to introduce air from the air inlet, wherein the impeller drives the air into one end of the more than one pressure diffusion duct and to flow out from another end of the more than one pressure diffusion duct;

wherein, the axial diffuser comprises more than one positioning post, and the motor stator comprises more than one positioning groove mated with the more than one positioning post; and some of the diffuser blades extend along an axial direction of the axial diffuser to form the more than one positioning post.

16. The cleaning device according to claim 15, wherein an impeller chamber and an annular no-gate channel surrounding the impeller chamber are formed between the air inlet cover and the axial diffuser, and the annular no-gate channel communicates the impeller chamber with the more than one pressure diffusion duct.

17. The cleaning device according to claim 15, wherein, an outer diameter of the main body portion is equal to an outer diameter of the motor stator, enabling the air flowing out from the more than one pressure diffusion duct to flow through an outside of the motor stator.

* * * * *